US007640688B2

(12) United States Patent
Oz

(10) Patent No.: US 7,640,688 B2
(45) Date of Patent: Jan. 5, 2010

(54) ADJUSTABLE CHEEK REST AND ACCESSORY RAIL FOR FIREARMS

(75) Inventor: Moshe Oz, Natanya (IL)

(73) Assignee: Command Arms Accessories, Bensalem, PA (US)

( * ) Notice: Subject to any disclaimer, the term of this patent is extended or adjusted under 35 U.S.C. 154(b) by 49 days.

(21) Appl. No.: 11/818,587

(22) Filed: Jun. 14, 2007

(65) Prior Publication Data

US 2007/0289190 A1 Dec. 20, 2007

Related U.S. Application Data

(60) Provisional application No. 60/859,273, filed on Nov. 15, 2006, provisional application No. 60/814,139, filed on Jun. 16, 2006.

(51) Int. Cl.
*F41C 23/00* (2006.01)

(52) U.S. Cl. ..... 42/73; 42/72; 42/71.01

(58) Field of Classification Search ..... 42/71.01, 42/72–74

See application file for complete search history.

(56) References Cited

U.S. PATENT DOCUMENTS 4,663,877 A 5/1987 Bragg ..... 42/74
5,031,348 A 7/1991 Carey ..... 42/74
5,711,102 A 1/1998 Plaster et al. ..... 42/71.01
5,970,642 A 10/1999 Martin ..... 42/73
6,839,998 B1 1/2005 Armstrong ..... 42/71.01
2008/0028662 A1* 2/2008 Abraham et al. ..... 42/73

* cited by examiner

*Primary Examiner*—Stephen M Johnson
*Assistant Examiner*—Daniel J Troy
(74) *Attorney, Agent, or Firm*—Drinker Biddle & Reath LLP

(57) ABSTRACT

The present invention provides an adjustable cheek rest for installation on the butt stock of a firearm, the cheek rest having an elongate comb adapted to conform to the top portion of the butt stock, the comb being supported on a rail that is fixed to, or removably mounted to, one side of the butt stock. The cheek rest comb is adjustable both longitudinally and vertically with respect to the butt stock to suit the needs of a particular shooter, the comb being attached to the butt stock by a fixture slidably engaging the rail to permit longitudinal adjustment and slidably engaging the comb to permit vertical adjustment. Once adjusted, the comb may be secured in a desired longitudinal and vertical location. A removable rail is also provided for mounting the cheek rest and/or other accessories to a firearm butt stock not having a fixed accessory mounting rail.

2 Claims, 13 Drawing Sheets

ADJUSTABLE CHEEK REST AND ACCESSORY RAIL FOR FIREARMS

RELATED INVENTION

This application is related to and claims priority from U.S. Provisional Application No. 60/859,273, filed on Nov. 15, 2006, entitled "Removable Accessory Mounting Rail for a Firearm," and U.S. Provisional Application No. 60/814,139, filed on Jun. 16, 2006, entitled "Adjustable Cheek Rest for Firearms," the disclosures of which are incorporated herein by reference in their entirety.

FIELD OF THE INVENTION

The present invention relates generally to rail mounted accessories for firearms and, more particularly to an adjustable cheek rest that may be installed on a fixed or removable accessory rail on shoulder-mounted firearms such as carbines and rifles.

BACKGROUND OF THE INVENTION

Adjustable cheek rests on the butt stock of rifles and carbines assist the shooter in getting quickly and comfortably into proper sight alignment. Standard butt stocks do not account for different sizes and shapes of shooter physique, or different type aiming sights and scope mounts. An adjustable cheek rest allows the shooter to customize drop and eye relief adjustments such that when the shooter lays his cheek on the cheek rest, his dominant eye is automatically aligned with the sight system.

It has been a long known practice to provide an accessory mounting rail on a firearm for releasably attaching accessories, such as optics and lighting equipment. Common type accessory mounting rails include the Picatinny rails and the Weaver rails.

SUMMARY OF THE INVENTION

The invention provides a cheek rest assembly adapted for rail-mounted attachment on a firearm butt stock. The cheek rest assembly includes a comb having a generally U-shaped cross-section adapted to substantially conform to the underlying butt stock onto which the comb is mounted. The comb is adjustably mounted to enable adjustment of both the height (i.e., vertical distance when the firearm is leveled parallel to the ground) and longitudinal location of the comb (i.e., position parallel to the length of the firearm) with respect to the butt stock.

According to one embodiment, the cheek rest assembly includes a mounting fixture for attaching the comb to the butt stock. The mounting fixture includes a base which supports an arm, the arm having an elongate slot adapted for receiving an internally threaded stud extending from the comb. A mounting plate is received onto the stud, and a capped bolt engages the internal threads of the stud. When the capped bolt is tightened into the threaded stud, the arm is clamped between the washer and the comb, thereby adjustably securing the comb to the arm at a desired location on the arm. The location of the bolt may be adjusted along the elongate slot in arm to provide adjustment in the height of the comb with respect to the butt stock.

The base of the mounting fixture comprises a substantially C-shaped cross-section dimensioned for sliding receipt of an accessory rail carried by the butt stock. Sliding movement of the base of the mounting fixture along the accessory rail results in translation of the arm of the mount forward and backward, thereby longitudinally adjusting the comb with respect to the butt stock. Preferably, an engagement mechanism is carried or defined by the base of the mounting fixture for releasably securing the mounting fixture to the accessory rail in a desired location along the butt stock.

According one embodiment, the check rest assembly includes a removable accessory rail assembly for a firearm. The removable rail assembly includes a rail body and a mating backing member interconnected to each other for securing the mounting rail to the firearm. The rail body and the backing member are attached to each other through an elongate opening in the butt stock. The rail body and the backing member are preferably attached to each other using threaded fasteners. The rail body includes a mounting platform and a base, the based being adapted to distance the mounting platform from the butt stock to provide access to the mounting platform for releasably attaching an accessory to the mounting platform. The mounting platform preferably includes outwardly protruding lobes for engagement with a cooperatively formed portion of an accessory in the manner of a dove-tail connection for securing the accessory to the firearm.

BRIEF DESCRIPTION OF THE DRAWINGS

For the purpose of illustrating the invention, the figures show a form of the invention that is presently preferred. However, it should be understood that this invention is not limited to the precise arrangements and instrumentalities shown.

DESCRIPTION OF THE INVENTION

Referring to the figures, where like numerals identify like elements, there is shown in FIGS. 1 through 4 a cheek rest assembly 10 according to an exemplary embodiment of the invention. The cheek rest assembly 10 is shown mounted on a butt stock 12 that is adapted for attachment to a carbine. The cheek rest assembly 10 includes a comb 14, one side of which defines a contact surface for a shooter's cheek. In the depicted embodiment of the cheek rest assembly 10 shown in FIGS. 1 and 2, the cheek contact area is on the left-hand side comb 14, for contact with the right cheek of a right-handed shooter. It is understood that the cheek rest assembly may just as readily be oriented with the contact surface on the right-hand side of the comb 14 for use by a left-handed shooter. The cheek rest assembly 10 provides adjustability of both the height of the comb 14 with respect to the butt stock 12 and the location of the comb 14 longitudinally along the butt stock 12.

Figure 3:
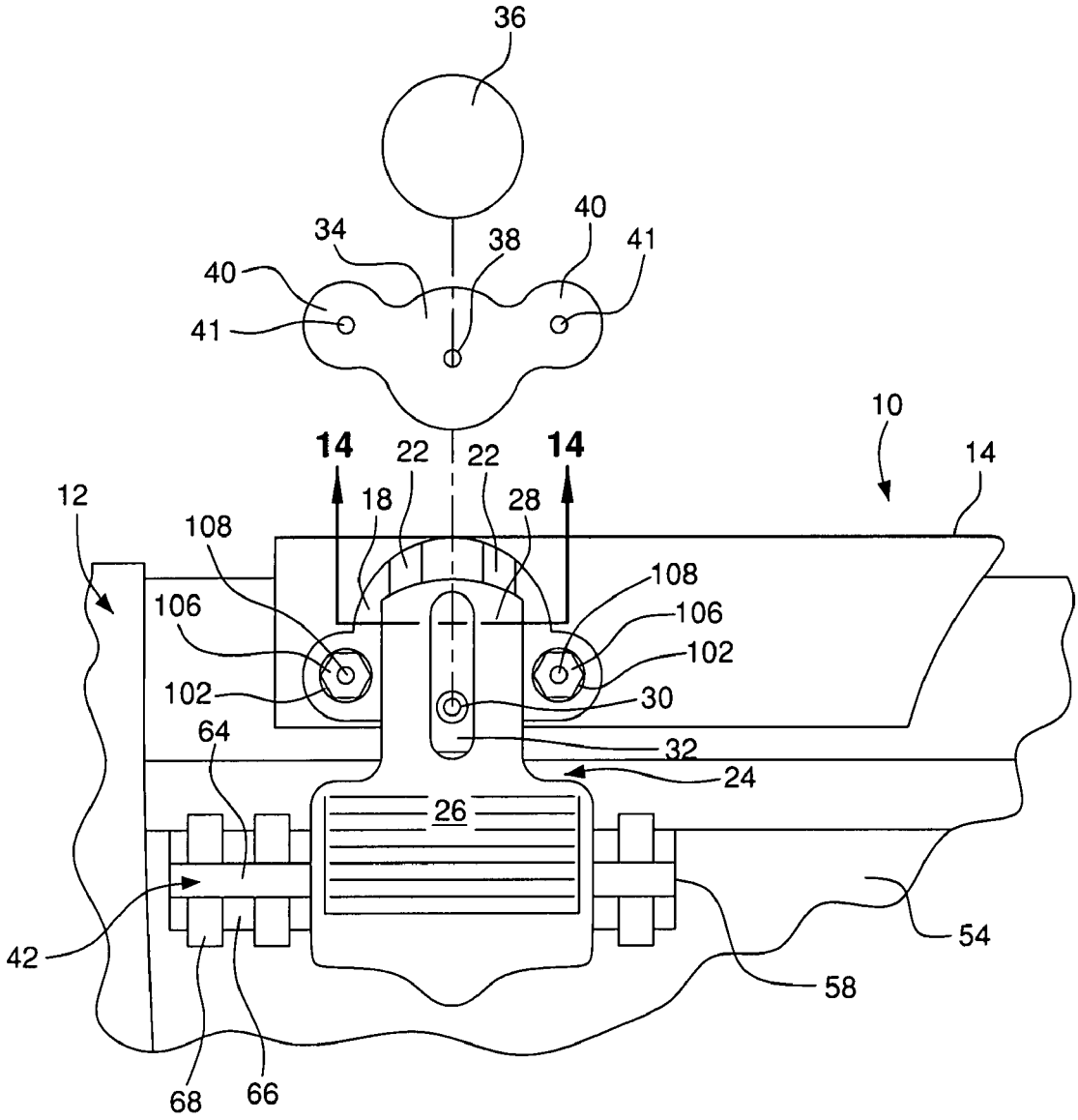
FIG. 3 shows a right-hand side view of the cheek rest assembly of FIG. 1, the cheek rest assembly being in a raised position with respect to the butt stock and shown with the mounting plate and the threaded cap of the cheek rest assembly separated from the assembly.

As shown in FIGS. 1 through 4, the comb 14 comprises an elongate body 16 having a substantially U-shaped cross-section that generally conforms to an upper portion of the butt stock 12 when the comb 14 is in the fully-lowered position over to the butt stock 12. As best illustrated in FIG. 3, the comb 14 is connected to a carrier 18 secured to the body 16. The comb 14, body 16 and carrier 18 are preferably formed from molded plastic. As shown, the carrier 18 is bolted to the body 16, but the carrier 18 may also be fastened by other equivalent conventional fastening means to the body 16, or the carrier 18 may be formed integrally onto the body 16 as a molded unit.

Figure 4:
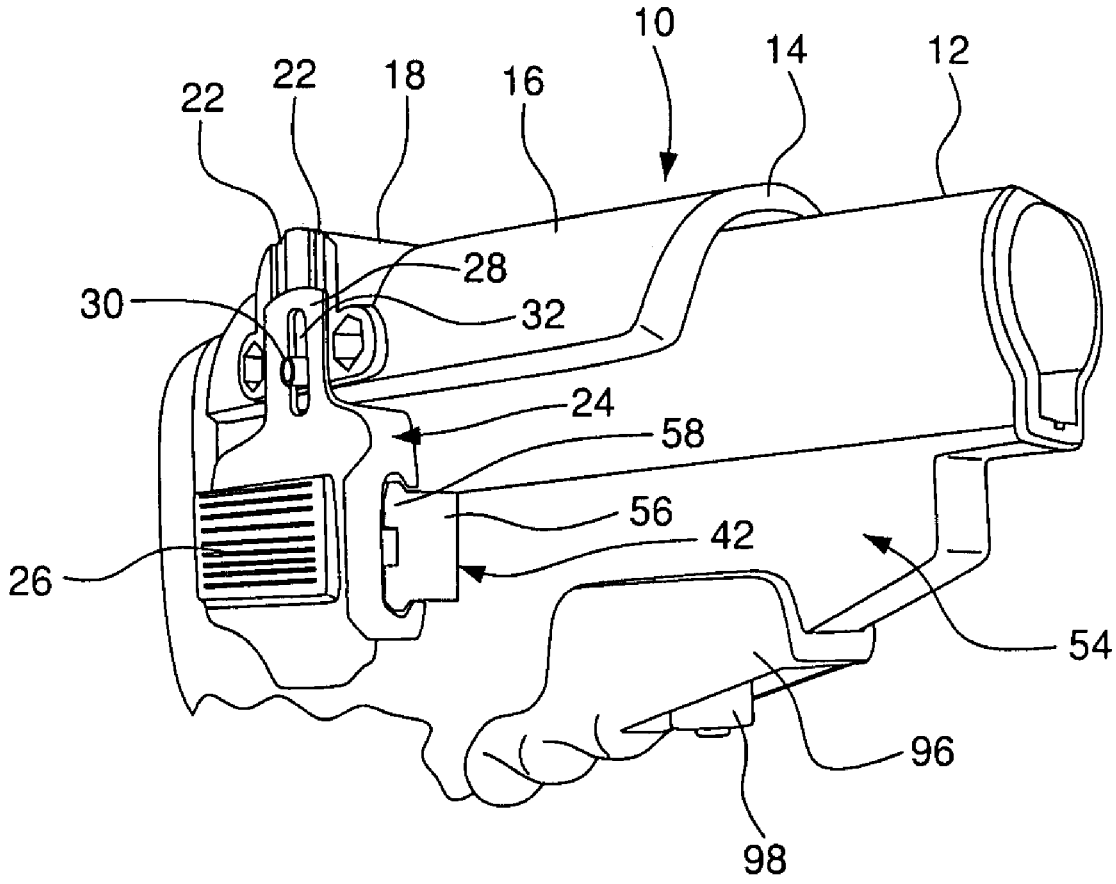
FIG. 4 shows a perspective view of the cheek rest assembly of FIG. 1, the comb of the assembly being in a raised position with respect to the butt stock, with the mounting plate and the threaded cap removed from the assembly.

With reference particularly to FIGS. 3 and 4, the carrier 18 includes a pair of recessed nut mounts 102 each defining an interior for receiving a hexagonal nut 106, and an aperture for receiving a bolt 108. The bolts 108 extend through the body 16 and the carrier 18 and are engaged by the nuts 106, securing the carrier 18 to the body 16. The carrier 18 further includes an internally threaded stud 30 that extends outwardly therefrom. A pair of substantially vertical guide grooves 22 recessed into a front face of the carrier 18 are disposed on opposite sides of the stud 30.

Figure 14:
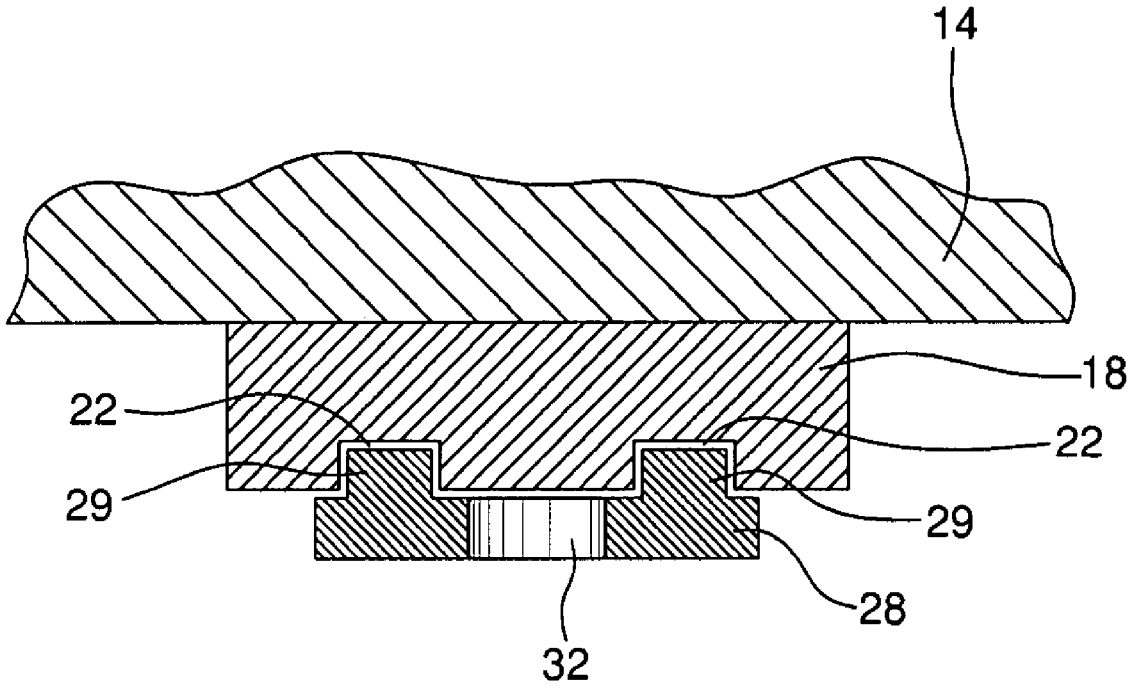
FIG. 14 shows a partial sectional view of the cheek rest assembly if FIG. 3, taken through section 14-14.

The cheek rest assembly is installed onto the butt stock using a mounting fixture 24 that has a base 26 and a substantially vertically extending arm 28. The mounting fixture 24 is used to adjustably position the comb 14 at a desired height over the butt stock 12, and by moving to a different slot along the rail, locate the comb at a desired longitudinal location along the butt stock 12. The base 26 is coupled to the rail on the butt stock, and the arm 28 is coupled to the carrier 18. A stud 30 extends outwardly from the carrier 18 of the comb 14 and is received through an elongate slot aperture 32 defined by branches of the arm 28 of the mounting fixture 24. A pair of guide tabs 29 projects inwardly from the arm 28, the guide tabs 29 being disposed on opposite sides of the aperture 32, as illustrated in FIG. 14. The guide tabs 29 are adapted to be received into the corresponding guide grooves 22 in the carrier 18. The engagement between the guide tabs 29 of the arm 28 and the guide grooves 22 of the carrier 18 positions the comb 14 with respect to the mounting fixture 24 and guides the upward or downward movement of the comb 14 with respect to the butt stock 12.

As best seen in FIG. 3, a mounting plate 34 having a central mounting aperture 38 and two lobe extensions 40 is received onto the stud 30 over the arm 28, the mounting aperture 38 aligning with and receiving the internally threaded stud 30. The lobes 40 are adapted to overlay the nut mounts 102 of the carrier 18, thereby concealing and protecting the fasteners 106, 108 located within the nut mounts 102, the lobes 40 having dimples 41 adapted to be seated over the nut mounts 102 to maintain the orientation of the mounting plate 34. A capped bolt 36 is received through the mounting aperture 38 of the mounting plate 34, engaging the internal threads of the stud 30. Tightening the bolt 36 into the stud 30 causes the arm 28 to be clamped between the carrier 18 and the mounting plate 34, thereby adjustably securing the comb 14 at a desired height with respect to the butt stock 12. The lobe dimples 41 on the mounting plate 34 maintain the mounting plate 34 in alignment with the arm 28. When the capped bolt 36 is loosened from the stud 30, the mounting plate 34 and carrier 18 may be slidably adjusted along the arm 28 to move the comb 14 upward or downward with respect to the butt stock 12.

Figure 1:
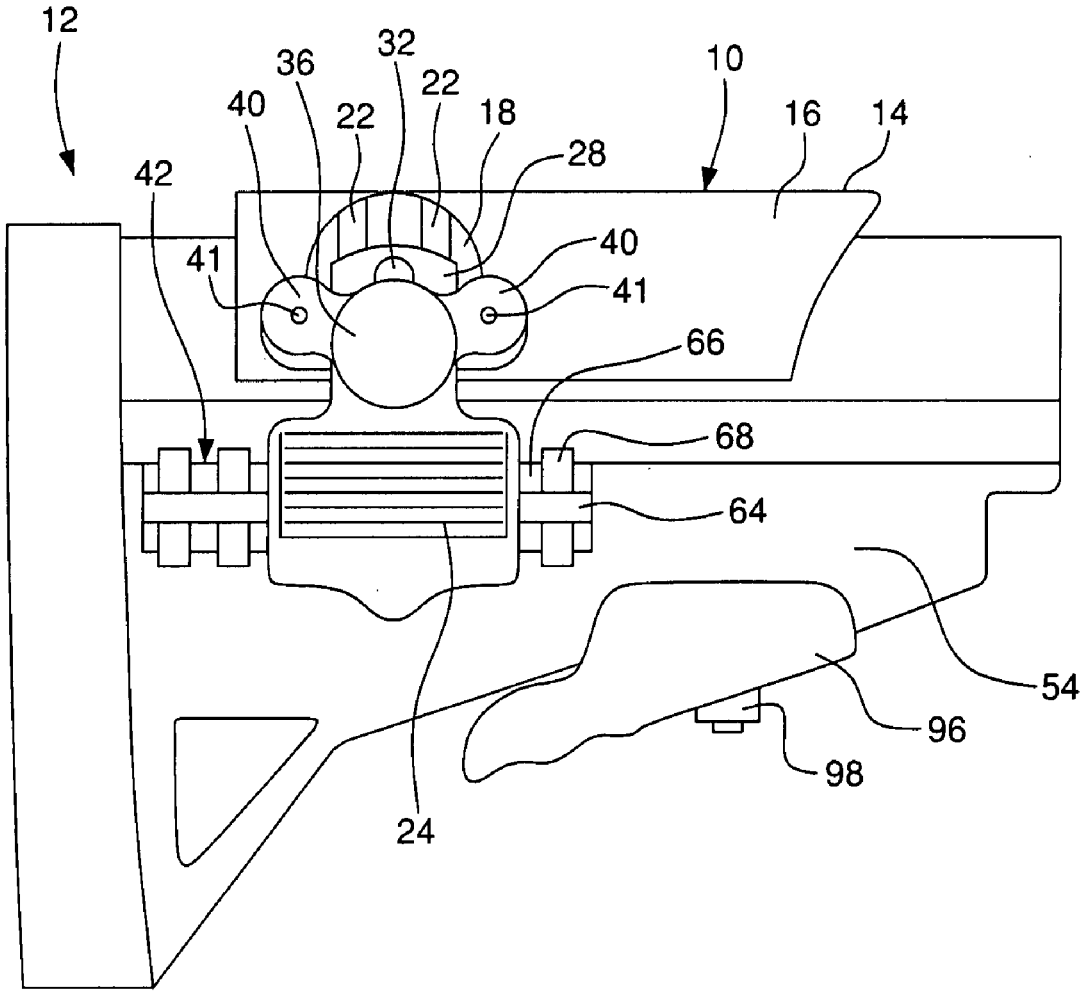
FIG. 1 shows a right-hand side view of the cheek rest assembly according to the present invention mounted to a butt stock for a carbine, the comb of the assembly being in a fully-lowered position with respect to the butt stock.
Figure 2:
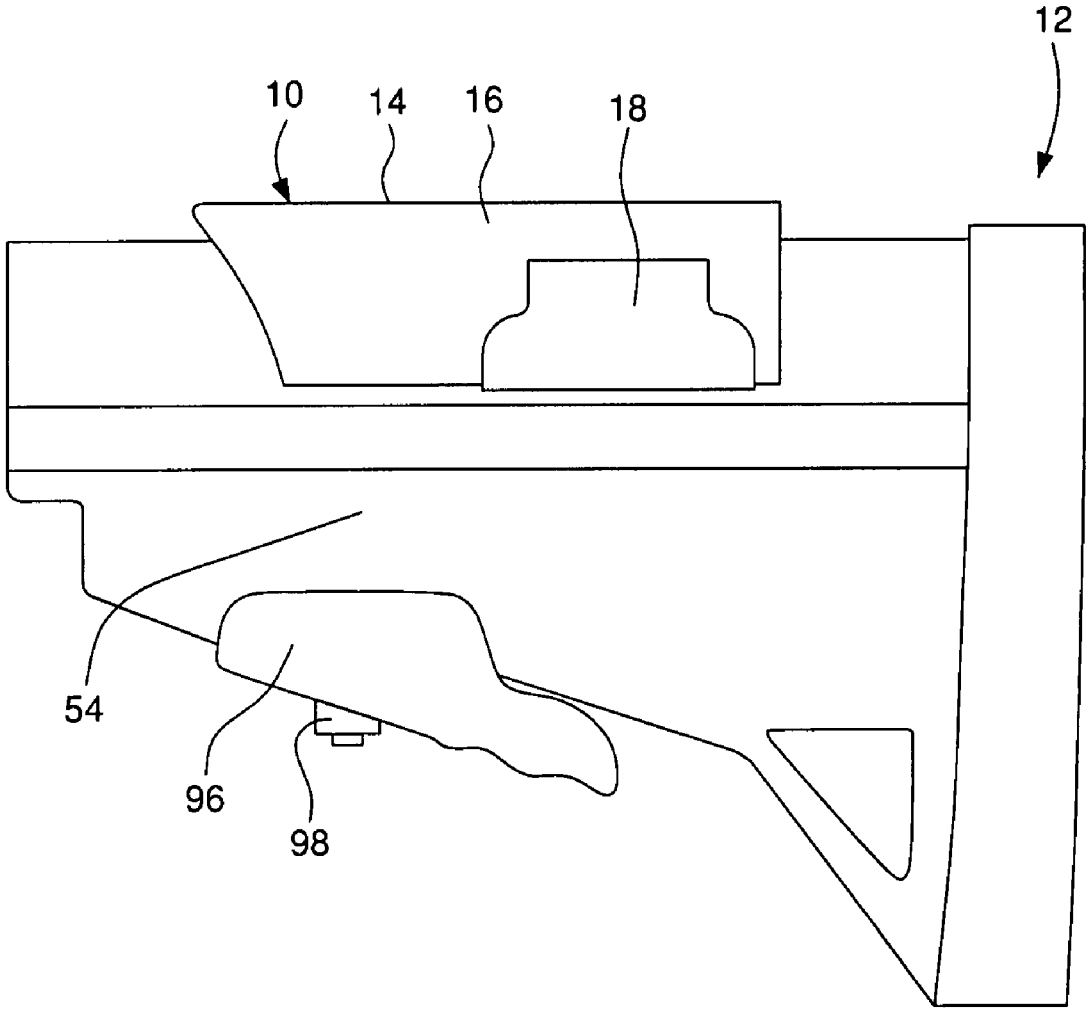
FIG. 2 shows a left-hand side view of the cheek rest assembly of FIG. 1.

An accessory mounting rail 42 is preferably mounted on the butt stock 12, as shown in FIGS. 1, 3, and 4. The accessory rail 42 has a roughly T-shaped cross-section and may be dimensioned to be a standard Picatinny or Weaver rail or other similar configuration.

In an embodiment of the check rest assembly 10 as shown in FIGS. 3 and 4, the base 26 of the mounting fixture 24 has a generally C-shaped cross-section dimensioned to slide over the accessory rail 42 and be locked into position along the rail. Accordingly, when the assembly 10 is mounted to the butt stock 12 via the mounting fixture 24, the position of the comb 14 may be adjusted longitudinally along the butt stock 12 by sliding the mounting fixture 24 along the accessory rail 42. The mounting fixture 24 includes a typical engagement latch (not illustrated) for releasably securing the mounting fixture 24 to the accessory rail 42 in a desired location on the rail 42.

For butt stocks that do not have a built-in accessory rail, the present invention also includes a mechanism to allow an accessory rail assembly 44 to be removably mounted on the butt stock 12. FIGS. 5 through 8 show an exemplary embodiment of the removable accessory rail assembly 44. The accessory rail assembly 44 includes an accessory rail body 46 and a mating backing member 48. As illustrated, the accessory rail body 46 is located on a right-hand side of the butt stock 12 and the mating backing member 48 is located on an opposite left-hand side of the butt stock 12. The accessory rail assembly 44 is secured to the butt stock 12 by attaching the rail body 46 to the backing member 48 using an attachment means 50 that passes through an elongate aperture 52 in a recessed plate 54 of the butt stock 12.

The rail body 46 extends in a longitudinal direction and has a generally T-shaped cross-section comprising a base 56 and a mounting platform 58 both extending the length of the rail body 46. The mounting platform 58 is wider than the base 56 and is attached to one side of the base 56, the mounting platform 58 extending outwardly from the base 56 in opposite directions transverse to the longitudinal rail body 46. An opposite side 60 of the base 56 contacts the recessed plate 54 and overlays the aperture 52 of the butt stock 12. The base 56 functions to distance the mounting platform 58 of the rail body 46 from the recessed plate 54 in order to provide access to the mounting platform 58 for attaching an accessory to the rail body 46.

The mounting platform 58 includes a longitudinal slot 64 extending the full length of the mounting platform 58, and further includes a plurality of laterally-extending cross slots 66. The slotting of the mounting platform 58 in this manner provides stability to the mounting platform 58 by allowing for expansion and contraction without significant distortion of the mounting platform 58 as the firearm heats and cools. Because the rail body 46 is interconnected to the backing member 48 through the elongate aperture 52 in the recessed plate 54 of the butt stock 12, the rail body 46 is permitted to expand and contract in the longitudinal direction in reaction to the heating or cooling of the firearm.

As shown in FIGS. 5, 7, 8, 12A, and 12B, the mounting platform 58 comprises a plurality of lobes 68 protruding outwardly from the rail body 46, the lobes 68 being defined by the longitudinal slot 64 and the cross slots 66. The outwardly protruding lobes 68 are adapted to receive a cooperatively formed mounting portion of an accessory in the manner of a dove-tail connection for securing the accessory to the mounting platform 58 of the rail body 46. Typically, the mounting portion of the accessory may be of at least two forms. In one form, the mounting portion of the accessory is generally C-shaped and is adapted to slidably engage the outwardly protruding lobs 68 of mounting platform 58 from either end of the rail body 46. In another form, the mounting portion of the accessory comprises a mechanism for clamping onto the mounting platform 58 so as to envelope the lobes 68, for example by having first and second portions of the accessory movably connected to each other to move between relatively opened and closed positions, or by having a rail grabbing means such as bolts, thumbscrews, or levers. The depicted rail body 46 is configured as a Picatinny rail. However, the present invention is not limited to any particular rail, and it is envisioned that the rail body 46 could be configured as a Weaver rail or other similar accessory rail form.

Figure 5:
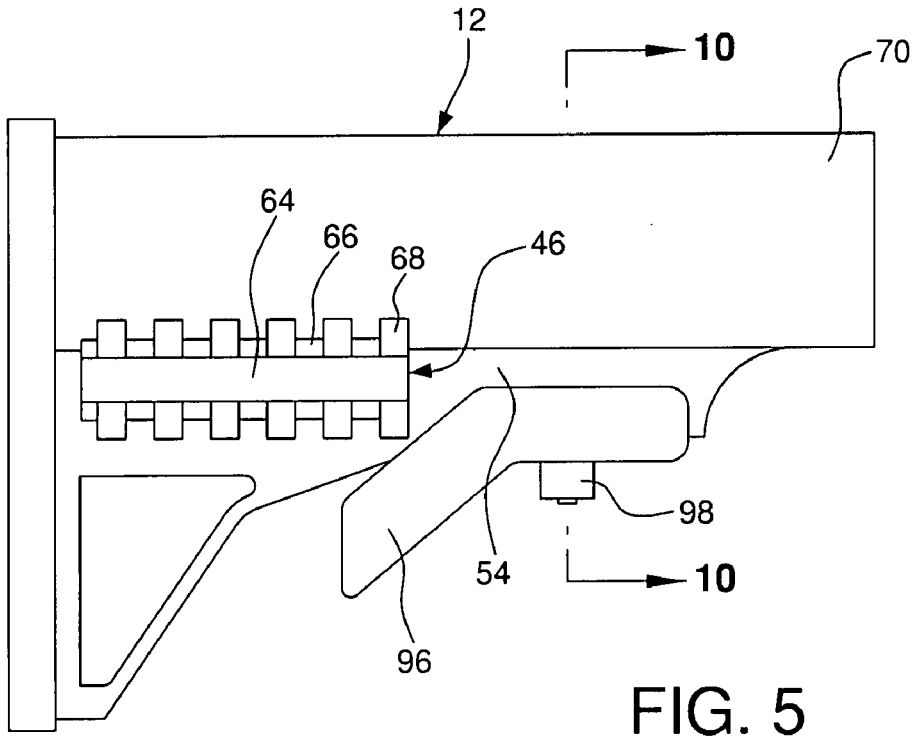
FIG. 5 shows a right-hand side view of the accessory rail body of the removable accessory rail assembly mounted to the right-hand side of the butt stock.
Figure 6:
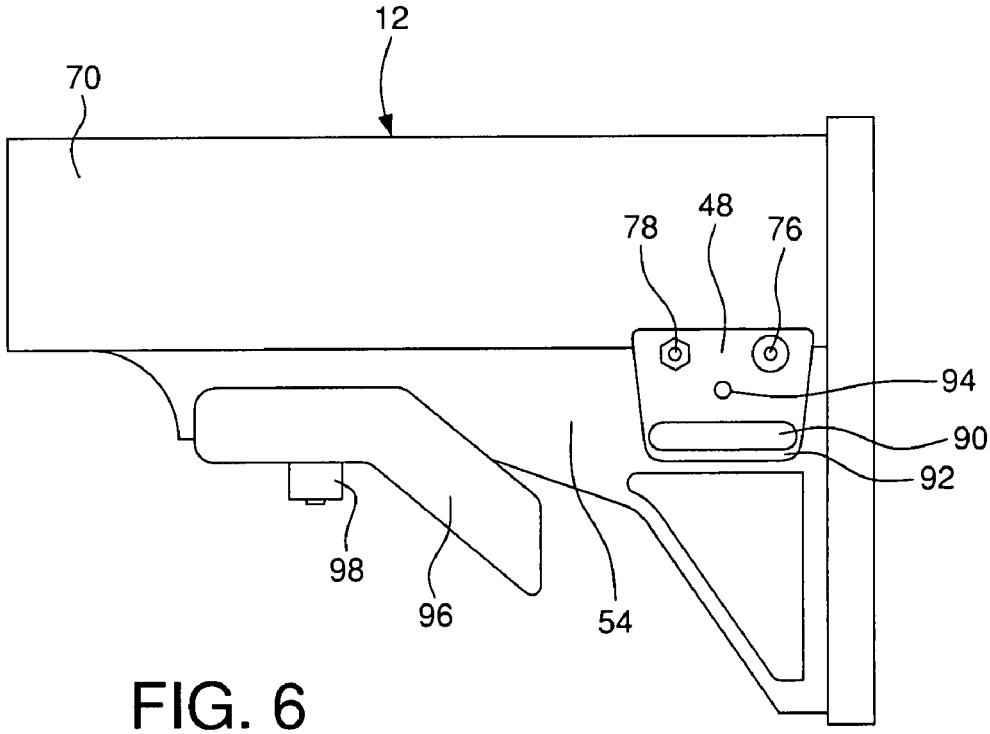
FIG. 6 shows a left-hand side view of the backing plate of the removable accessory rail assembly mounted to the left-hand side of the butt stock.
Figure 11A:
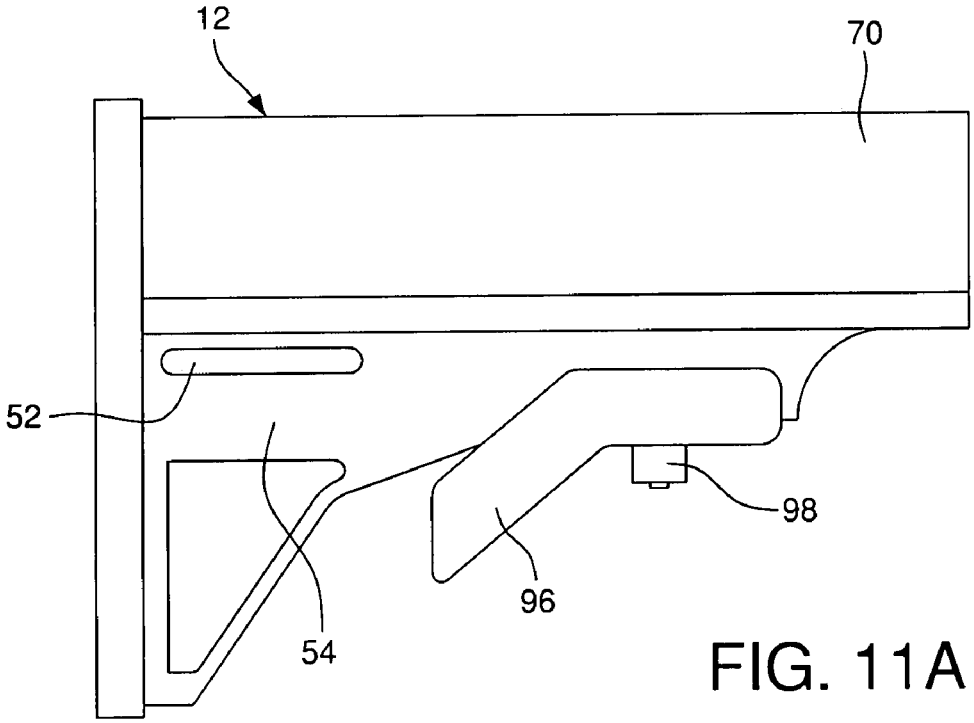
FIGS. 11A and 11B show right-hand and left-hand side views, respectively, of the butt stock of FIG. 1 with the accessory rail body and backing member removed from the butt stock.
Figure 11B:
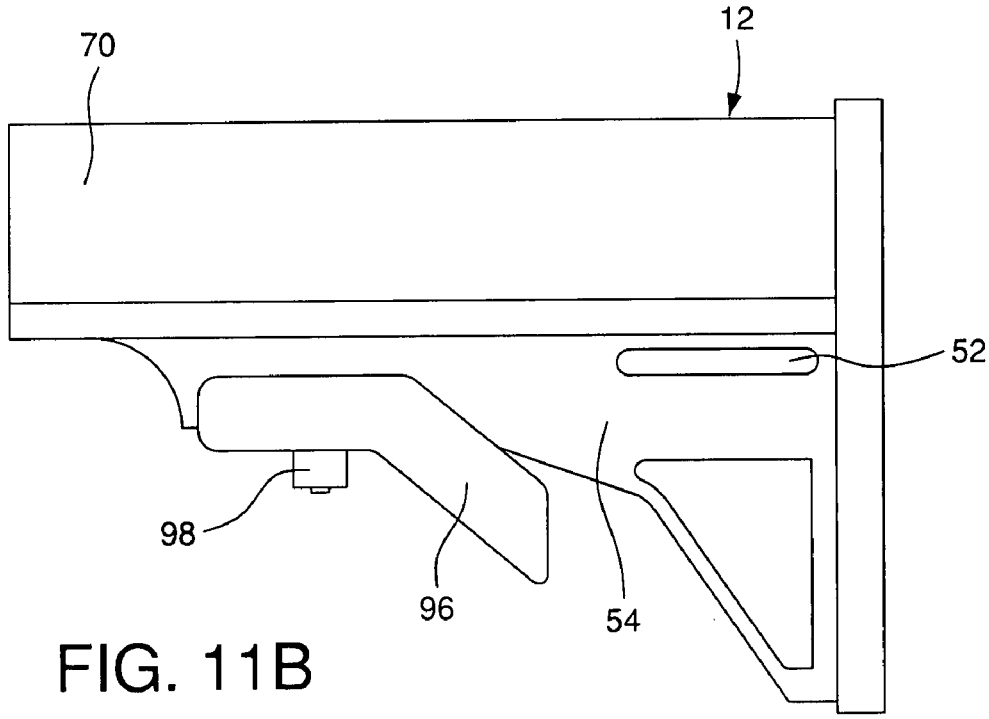
Figure 12B:
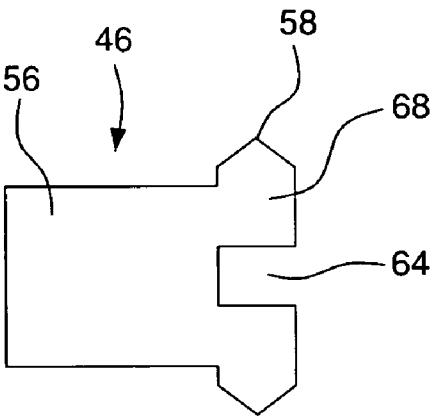
FIGS. 12A and 12B show backside and end views, respectively, of the accessory rail body removed from the butt stock.
Figure 12A:
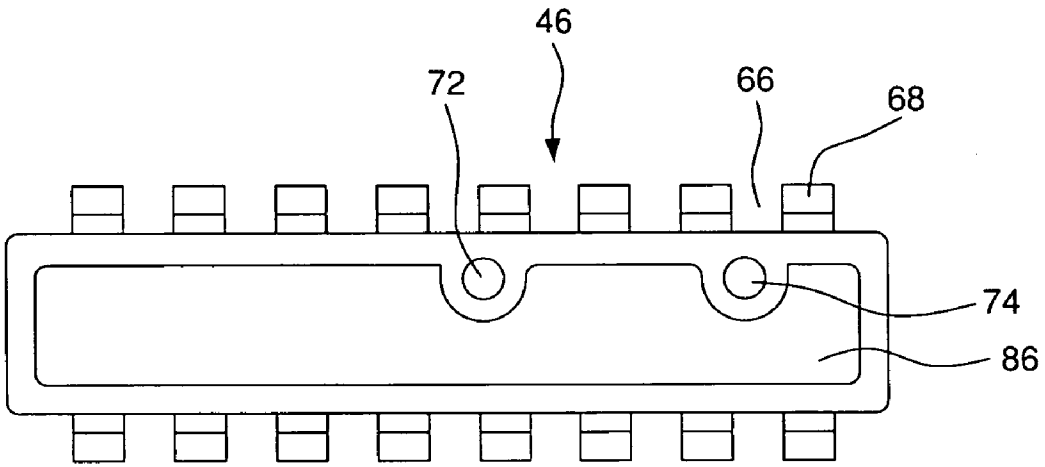
Figure 13B:
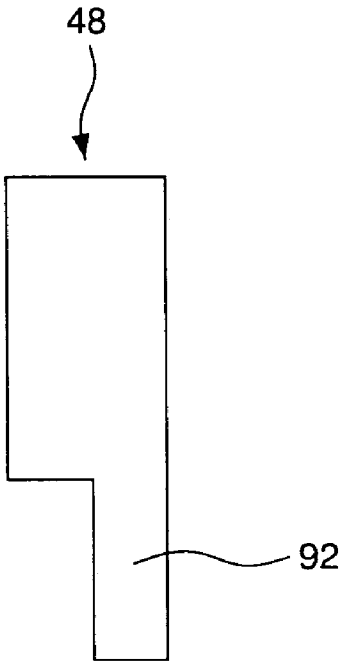
FIGS. 13A and 13B show backside and end views, respectively, of the backing plate removed from the butt stock.

Referring to FIGS. 5 through 9 and 11A through 13B, the rail body 46 and the backing member 48 of the removable accessory rail assembly 44 are adapted for attachment to each other to secure the rail body 46 to the butt stock 12. As shown in FIGS. 11A and 11B, the butt stock 12 includes the elongate aperture 52 in the recessed plate 54 adjacent to a sleeve portion 70 of the butt stock 12. The aperture 52 provides for passage of connectors between the rail body 46 and the backing member 48. The rail body 46 and the backing member 48 are secured to each other and to the butt stock 12 using an attachment means 50, a preferred attachment means 50 being described as follows. As shown in FIGS. 5, 12A, and 12B, the rail body 46 comprises an opening 72 for receiving a threaded bolt 80 and another opening 74 for receiving a threaded nut 82. As shown in FIGS. 6, 13A, and 13B, the backing member 48 include an opening 76 for receiving a threaded bolt 80 and another opening 78 for receiving a threaded nut 82. The interconnecting bolts 72 pass through the elongate aperture 54 in the recessed plate 54 of the butt stock 12 and engage mating nuts 74, the bolts 72 and the nuts 74 being secured with the respective openings in the rail body 46 and the backing member 48. It is understood that other attachment means 50 known in the mechanical arts could alternately be used to secure the rail body 46 and the backing member 48 to each other and to the butt stock 12.

Figure 13A:
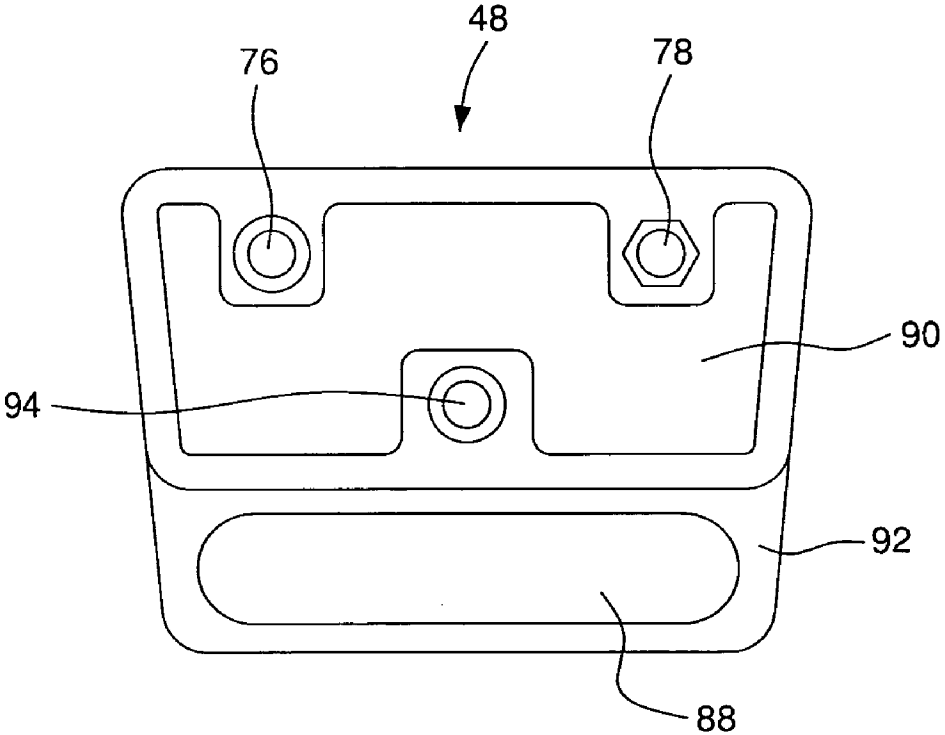

As shown in FIG. 12A, the base 56 of the rail body 46 is not solid but comprising recessed portions 86, to decrease the contact surface area between the rail body 46 and the butt stock 12. Limiting the contact area serves to limit the heat transfer between the firearm and the rail body, which decrease the thermal expansion and contraction of the rail body 46 as the firearm heats and cools. Similarly, as shown in FIG. 13A, the backing member 48 also includes a recessed portion 90 that limits the contact area between the backing member 48 and the butt stock 12.

Figure 7:
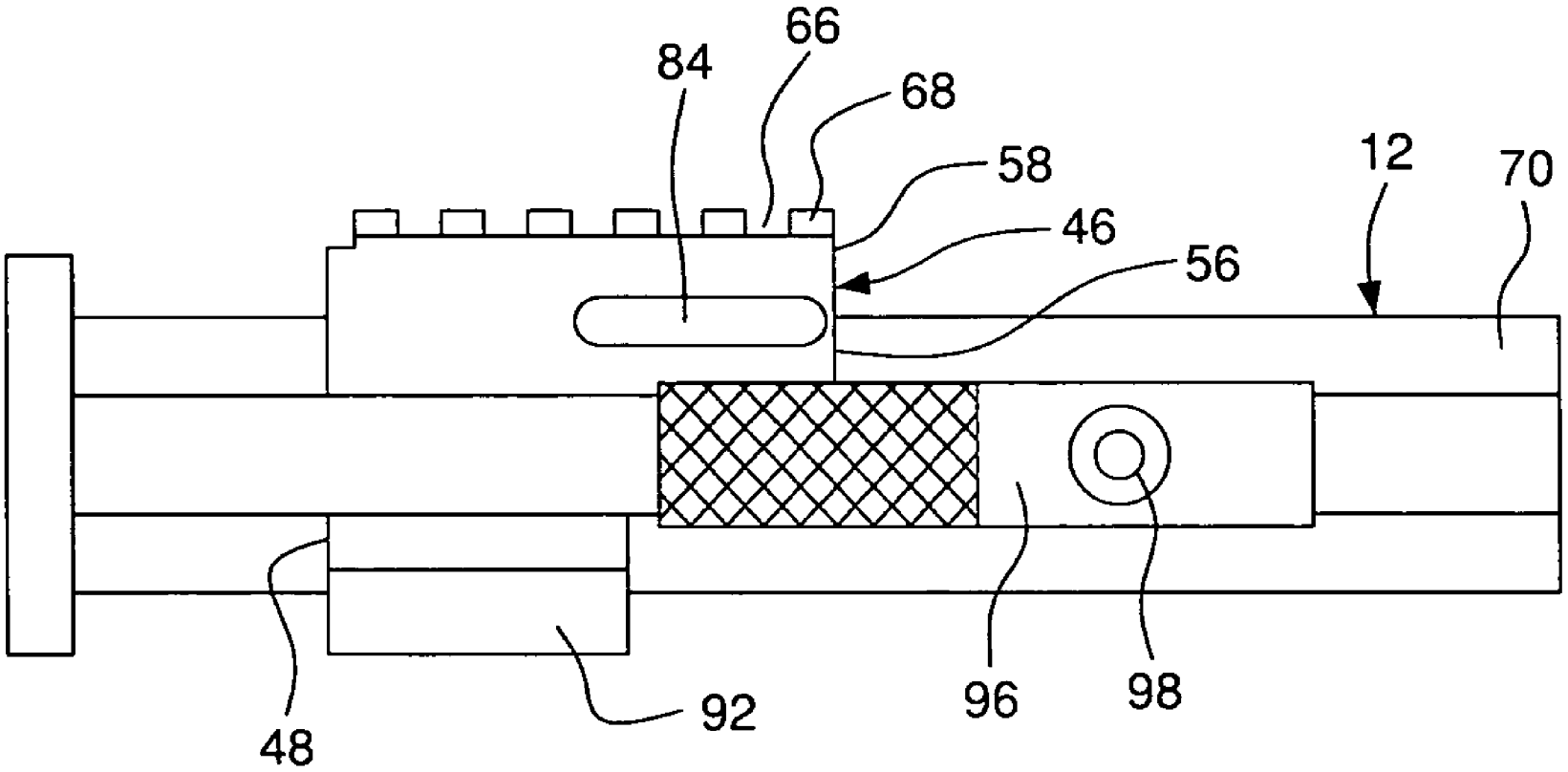
FIG. 7 shows a bottom view of the accessory rail body and the backing member mounted to the butt stock.
Figure 8:
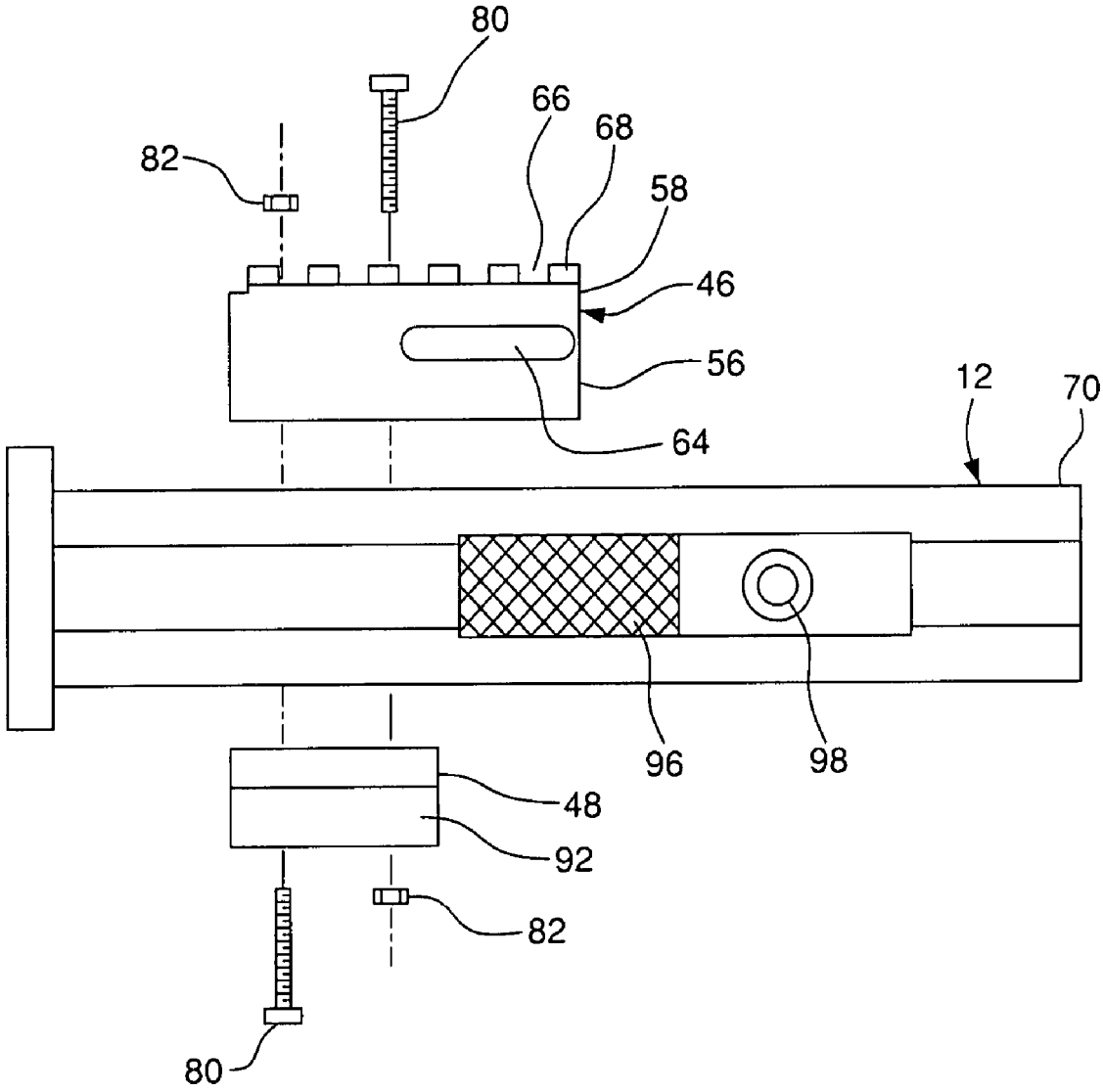
FIG. 8 shows an exploded bottom view of FIG. 7, wherein the accessory rail body and the backing member are removed from the butt stock.
Figure 9:
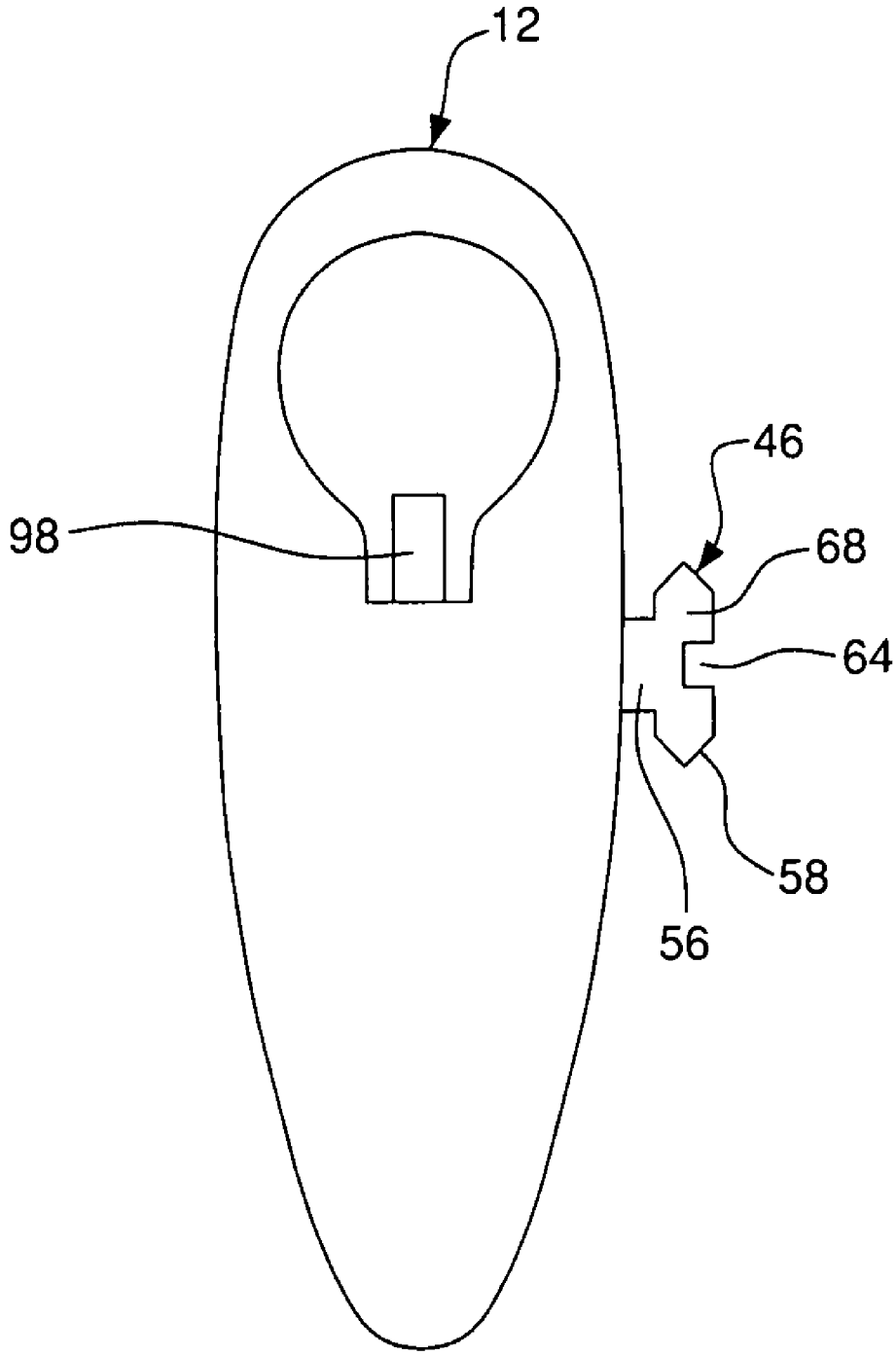
FIG. 9 shows a rear end view of the removable accessory rail assembly, including the rail body and backing member, mounted to the butt stock.
Figure 10:
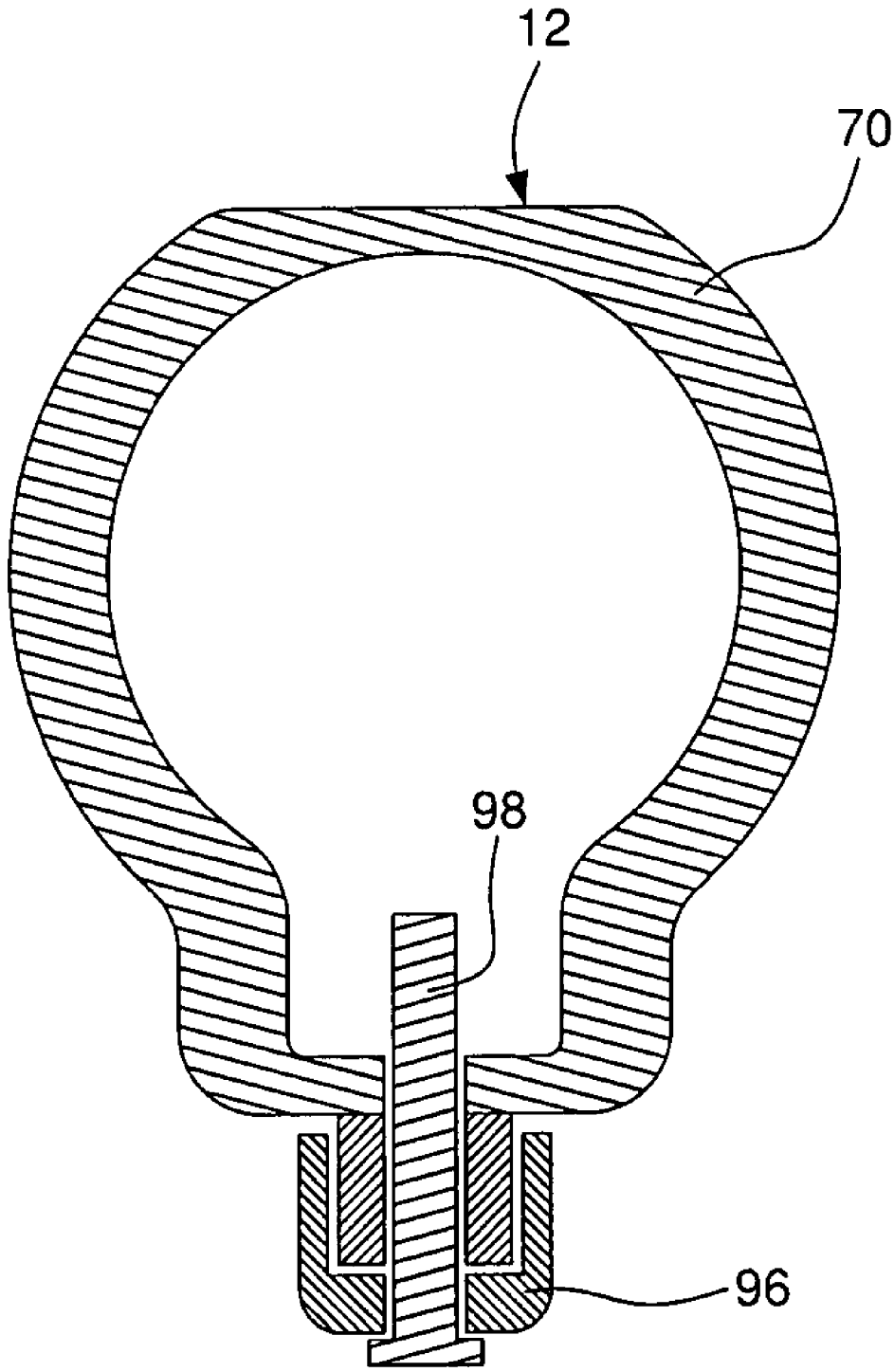
FIG. 10 shows a sectional view of the butt stock taken through the section 10-10 of FIG. 5.

Referring to FIGS. 7 and 8, the base 56 of the rail body 46 may further include an elongate slotted aperture 84 disposed at an intermediate location between the mounting rail 58 and the butt stock 12 when the rail body 46 is mounted to the butt stock 12. Accordingly, the slotted aperture 84 is adapted to receive a hook, clip, or other looped element, for example for hanging support of the firearm. Referring to FIGS. 6, 8, 13A, and 13B, the backing member 48 may further include an opening 94 for receiving a bolt and nut combination for mounting another accessory, and an elongate aperture 88 for receiving yet another accessory. The elongate aperture 88 is defined by a portion 92 of the backing member 48, the portion 92 being thinner than the backing member 48, the portion 92 further being spaced apart from the butt stock 12 when the backing member 48 is mounted to the butt stock 12. Accordingly, the slotted aperture 88 is adapted to receive a hook, clip, or other looped element, for example for hanging support of the firearm.

As illustrated in FIGS. 1, 2, 4 through 8, and 10 through 11B, the butt stock 12 includes a spring-loaded pin 98 extending into an interior defined by a sleeve portion 70 of the butt stock 12. The pin 98 is adapted for engaging receipt in an opening disposed in a tubular member of a carbine for securing the butt stock 12 to the carbine in the manner of a detent mechanism. The butt stock 12 includes a pivoting actuator 96 for retracting the pin 98 with respect to the interior of the sleeve portion 70 to release the carbine from the butt stock 12.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An adjustable cheek rest for the butt stock of a firearm, comprising:

a generally U-shaped elongate comb member adapted to substantially conform to the underlying butt stock;

a generally T-shaped rail mounted to the butt stock, the rail extending in a substantially longitudinal direction a fixture having a generally C-shaped member adapted to slidably receive the generally T-shaped rail and a generally vertically extending arm including an elongate aperture;

a stud extending outwardly from a surface of the comb member, the stud being adapted to slidably engage the elongate aperture of the fixture when the surface of the comb member is adjacent to a rear face of the arm of the fixture;

two recessed slots extending in a generally vertical direction on the surface of the comb member, one slot being disposed on either side of the stud;

two guide tabs protruding rearwardly from the rear face of the arm of the fixture, each rearwardly protruding tab being adapted to engage the corresponding recess slot for guiding the comb member as it is moved vertically with respect to the butt stock; and fastening means adapted to engage the stud, the fastening means having an enlarged cap, whereby the fastening means may be loosened to enable the comb member to be repositioned substantially vertically with respect to the butt stock and whereby the fastening means may be tightened to clamp the arm of the fixture between the cap and the comb member to secure the comb in a fixed vertical position with respect to the butt stock.

2. An adjustable cheek rest for the butt stock of a firearm as in claim 1, further including:

the comb being connected to a carrier by recessed nuts, the stud being a part of the carrier and located between the recessed nuts; and a mounting plate to cover the recessed nuts, the plate having a central aperture for passage of the stud and lobes to cover the recessed nuts, the plate being placed between the comb carrier and the mounting fixture.

* * * * *